US007950660B2

(12) United States Patent
Takeuchi

(10) Patent No.: US 7,950,660 B2
(45) Date of Patent: May 31, 2011

(54) SHEET FEEDER AND IMAGE FORMING APPARATUS

(75) Inventor: Masaru Takeuchi, Handa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 789 days.

(21) Appl. No.: 11/753,522

(22) Filed: May 24, 2007

(65) Prior Publication Data

US 2007/0273093 A1 Nov. 29, 2007

(30) Foreign Application Priority Data

May 29, 2006 (JP) ..... 2006-148788

(51) Int. Cl.
*B65H 5/02* (2006.01)

(52) U.S. Cl. ..... 271/272; 271/265.01; 271/258.01; 74/410

(58) Field of Classification Search ..... 271/258.01, 271/265.01, 272; 74/410
See application file for complete search history.

(56) References Cited

U.S. PATENT DOCUMENTS 5,181,715 A * 1/1993 Ohkoda et al. ..... 271/272
5,901,950 A * 5/1999 Kobayashi et al. ..... 271/3.24
5,949,470 A * 9/1999 Nakajima et al. ..... 347/262
6,622,582 B1 * 9/2003 Boyatt et al. ..... 74/410
2005/0230900 A1 10/2005 Yamada et al.
2006/0145413 A1 * 7/2006 Hwang ..... 271/258.01

FOREIGN PATENT DOCUMENTS

JP HO4-216564 A 8/1992
JP H06-048606 A 2/1994
JP H06-249328 A 9/1994
JP HO7-315659 A 12/1995
JP 2001310521 A 11/2001
JP 2005-265022 A 9/2005

OTHER PUBLICATIONS

Patent Office of the People's Republic of China; Notification of the Second Office Action in Chinese Patent Application No. 200710103770.9 (counterpart to the above-captioned U.S. patent application) mailed Feb. 12, 2010.
Japan Patent Office, Notification of Reason for Refusal in Japanese Patent Appl'n No. 2006-148788 (counterpart to the above-captioned U.S. patent application), dated Jun. 29, 2010.

* cited by examiner

*Primary Examiner* — Stefanos Karmis
*Assistant Examiner* — Luis A Gonzalez
(74) *Attorney, Agent, or Firm* — Baker Botts L.L.P.

(57) ABSTRACT

A sheet feeder includes a feed roller that includes a feed roller shaft, the feed roller being capable of feeding a sheet, a frame that supports the feed roller shaft, a helical gear attached to the feed roller shaft, a motor that drives the feed roller shaft via the helical gear, a disc attached to the feed roller shaft, a sensor body that detects a rotation of the disc, and a pressing member that presses the feed roller shaft from a side of the feed roller shaft in a thrust direction toward another side of the feed roller shaft.

13 Claims, 8 Drawing Sheets

SHEET FEEDER AND IMAGE FORMING APPARATUS

CROSS-REFERENCE TO RELATED APPLICATION

This application claims priority from Japanese Patent Application No. 2006-148788, filed on May 29, 2006, the entire subject matter of which is incorporated herein by reference.

TECHNICAL FIELD

The present invention relates to a sheet feeder for feeding a sheet to a printing position or the like, and an image forming apparatus which incorporates the sheet feeder.

BACKGROUND

JP-A-H09-249328 discloses a configuration in which a drive gear driven by a motor is meshed with a gear attached to a feed roller shaft, thereby allowing the rotation of the motor to be transmitted to the feed roller shaft via the gear. At this time, a helical gear is employed as the gear to transmit rotational motions smoothly and prevent occurrence of noise.

In such an arrangement, to control the rotation of the feed roller shaft, a disc is attached to the feed roller shaft, and a sensor body for detecting the disc being rotated is attached to the frame. The disc is disposed to pass through a slit in the sensor body, so that the sensor body detects magnetically or optically the rotation of the disc in a non-contact manner.

However, when the helical gear transmits the rotation of the motor, a thrust force determined by the tilt angle of teeth of the helical gear is produced. This thrust force may move the disc in the direction of thrust of the feed roller shaft. Thus, the disc may contact with the sensor body and may be worn out or scratched. In such a case, detection of rotational motions may fail.

SUMMARY

The configuration disclosed in JP-A-H09-249328 may be applied to a sheet feeder. However, in this configuration, depending on the direction of tilt of the helical gear teeth, a thrust force may act upon the drive gear of the motor outwardly from the motor when the motor is driven to feed a sheet, and the drive gear may move in the opposite direction when the motor is stopped. This is because of the internal structure of the motor that is adapted to correct for the thrust direction. Thus, when the drive gear of the motor is moved in the direction of thrust immediately after the motor is stopped, the helical gear meshing therewith causes a slight rotational force to occur. As a result, the feed roller shaft to be stopped may irregularity rotate, and thus stopping accuracy of the sheet may be deteriorated.

Aspects of the present invention provide a sheet feeder and an image forming apparatus that can prevent a disc from being worn out or scratched and improve stopping accuracy of a sheet.

An aspect of the invention provides a sheet feeder including: a feed roller that includes a feed roller shaft, the feed roller being capable of feeding a sheet; a frame that supports the feed roller shaft; a helical gear attached to the feed roller shaft; a motor that drives the feed roller shaft via the helical gear; a disc attached to the feed roller shaft; a sensor body that detects a rotation of the disc; and a pressing member that presses the feed roller shaft from a side of the feed roller shaft in a thrust direction toward another side of the feed roller shaft.

Further, another aspect of the invention provides an image forming apparatus including: a sheet feed unit that feeds stacked sheets one at a time; an image forming unit that forms an image on a sheet fed from the sheet feed unit, the image forming unit including a sheet feeder including: a feed roller that includes a feed roller shaft, the feed roller being capable of feeding a sheet; a frame that supports the feed roller shaft; a helical gear attached to the feed roller shaft; a motor that drives the feed roller shaft via the helical gear; a disc attached to the feed roller shaft; a sensor body that detects a rotation of the disc; and a pressing member that presses the feed roller shaft from a side of the feed roller shaft in a thrust direction toward another side of the feed roller shaft; and a sheet ejector that ejects the sheet on which the image is formed.

According to aspects of the invention, the sheet feeder is designed such that the pressing member presses the feed roller shaft in a thrust direction toward another side of the feed roller shaft. Thus, the normal rotation and reverse rotation of the motor prevents the feed roller shaft from moving in the direction of thrust even in the presence of a change in the direction of the thrust force. Accordingly, the disc can be prevented from being worn out or scratched.

Further, the sheet feeder is applicable to an image forming apparatus in a preferable manner.

DETAILED DESCRIPTION

Figure 1:
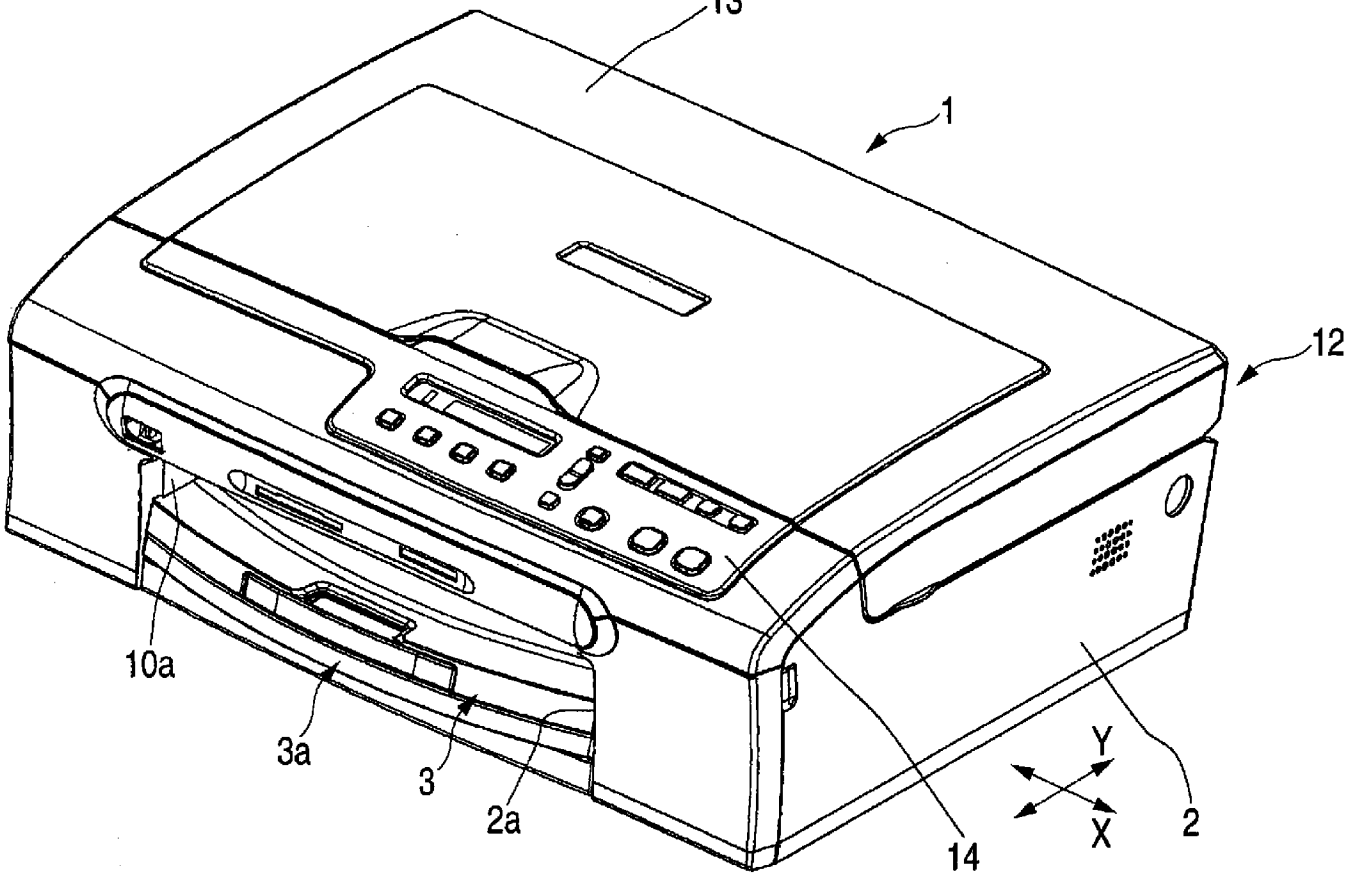
FIG. 1 is a perspective view illustrating an image forming apparatus having a recording apparatus with a sheet feeder according to an aspect of the present invention.
Figure 2:
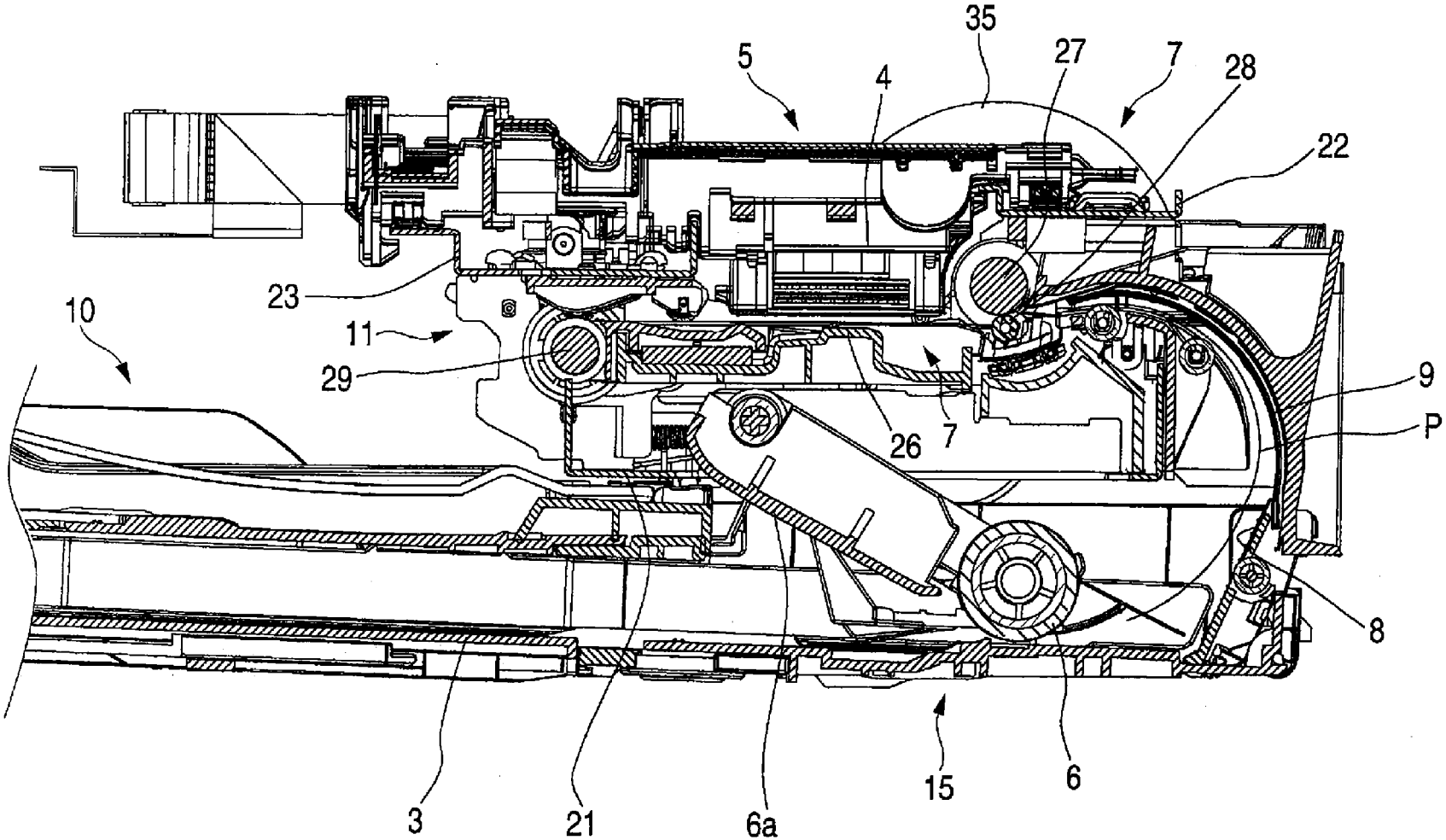
FIG. 2 is a cross-sectional view illustrating a portion of an image forming apparatus.
Figure 3:
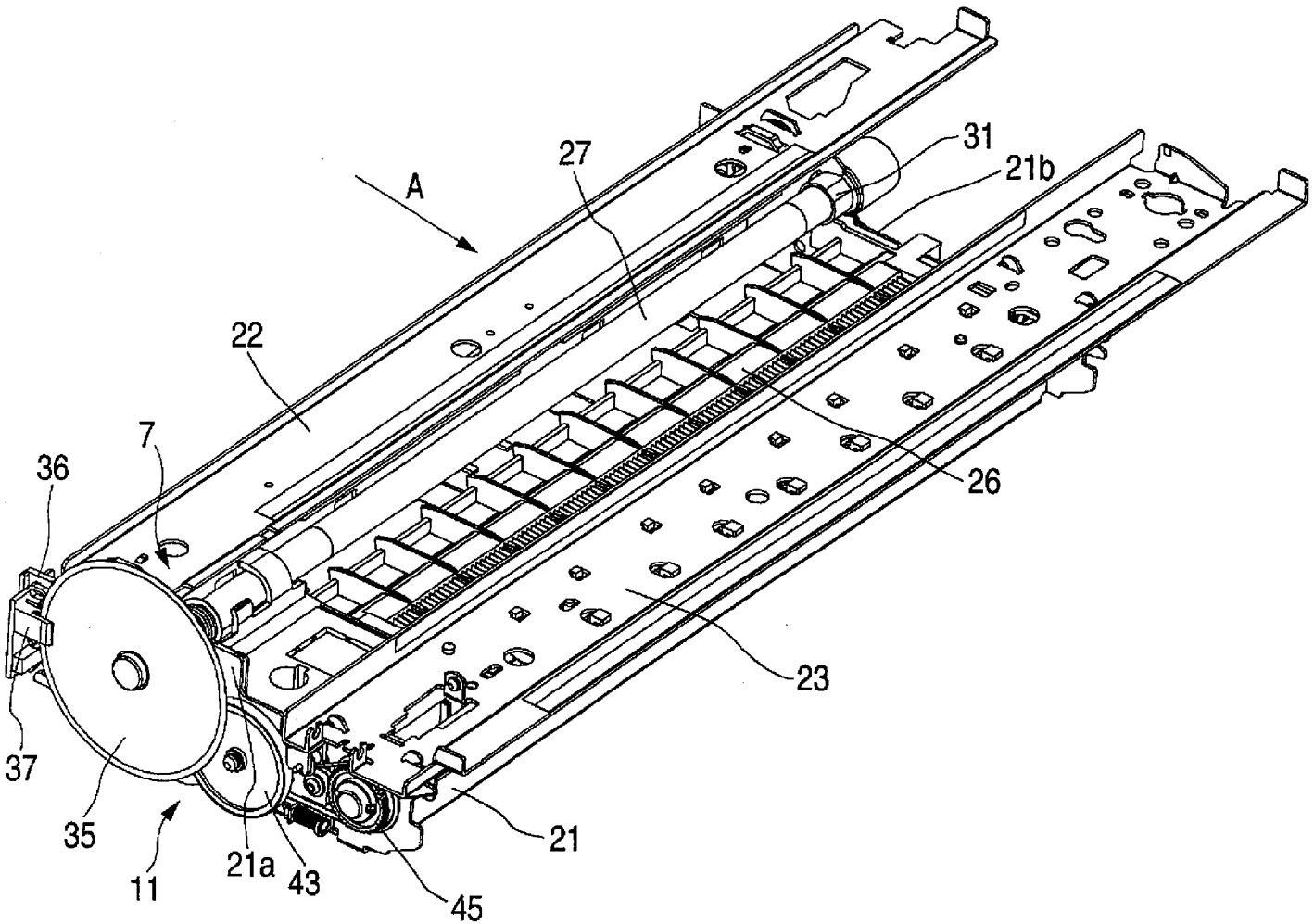
FIG. 3 is an enlarged perspective view illustrating a recording apparatus.

Aspects of the present invention will be described with reference to the drawings. FIG. 1 is a perspective view illustrating an image forming apparatus having a recording apparatus with a sheet feeder according to an aspect of the present invention. FIG. 2 is a cross-sectional view illustrating the main portion of an image forming apparatus. FIG. 3 is an enlarged perspective view illustrating a recording apparatus.

An image forming apparatus 1 is a multi function device (MFD) which has a printer function, copy function, scanner function, and facsimile function. A sheet feeder of the aspect of the present invention is applied to the image forming apparatus 1. As shown in FIG. 1, the image forming apparatus 1 has an apparatus body 2 made of a synthetic resin. On the bottom portion of the apparatus body 2, there is disposed a sheet feed cassette 3 that can be inserted into the apparatus body 2 through an opening portion 2*a* on the front of the apparatus body 2 (on the left side in FIG. 1). Hereinafter, the side on which the opening portion 2*a* is disposed is referred to as the front side or front, and with respect to this side, reference will be made to the front side, the right and left sides, and the rear side of the apparatus.

In this aspect, the sheet feed cassette 3 is configured to accommodate multiple sheets P such as an A4 size, letter size, legal size, or postcard size cut sheets, which are stacked (piled) one on top of the other. The sheets P are oriented so that their shorter side extends in a direction (main scanning direction or X-axis direction) which is perpendicular to the drawing surface of FIG. 1 and orthogonal to the direction of feeding of the sheets (sub-scanning direction or Y-axis direction) (see FIG. 1).

Incidentally, on top of the sheet feed cassette 3, an auxiliary sheet feed cassette 3*a* is disposed at its front end portion movably in the Y-axis direction to accommodate multiple reduced size sheets (not shown) stacked therein to be fed into the apparatus. Incidentally, in this aspect, the "sheet" includes any fed object, not only paper but also those of resin or metal, so long as it can be recorded. FIG. 1 shows the auxiliary sheet feed cassette 3*a* which is pushed into a location at which it is not protruded outwardly from the apparatus body (housing) 2. Further, in this aspect, the sheet feed cassette 3 is detachable from the apparatus body 2. However, the sheets may also be placed at a placement portion that cannot be detached from the apparatus body 2.

Additionally, at the back of the sheet feed cassette 3 (on the right side in FIG. 1 and FIG. 2), there is disposed a tilted separator plate 8 for separating sheets. On the apparatus body 2 side, there is disposed an arm 6*a* which has an upper end portion that is pivotable in the vertical direction. The sheet feed cassette 3 and the auxiliary sheet feed cassette 3*a*, a sheet feed roller 6 that is provided at a lower end of the arm 6*a* and is capable of feeding sheets P, the tilted separator plate 8 and the like constitute a sheet feed portion 15. The sheet feed portion 15 separately feeds, one at a time, sheets P or recorded media stacked in the sheet feed cassette 3 and the auxiliary sheet feed cassette 3*a*. A separated sheet P is fed via a horizontally and upwardly oriented U-turn path (feed path) 9 to a recording apparatus 11 as a recording portion, which is provided above and behind the sheet feed cassette 3.

As described in detail later, for example, the recording apparatus 11 includes a carriage 5, capable of a reciprocating motion, which is equipped with an ink jet type recording head 4 for implementing a printer function. The recording apparatus 11 also includes a sheet feeder 7, for feeding a sheet P, which is disposed between the lower face of the recording head 4 and a plate-shaped platen 26 for supporting a sheet P.

A sheet P recorded by the recording apparatus 11 is ejected with its recording face oriented upwardly at a sheet ejector portion 10. The sheet ejector portion 10 is formed above the auxiliary sheet feed cassette 3*a*, and a sheet outlet 10*a* (above an opening portion 2*a*) communicating with the sheet ejector portion 10 is opened toward the front of the apparatus body 2.

On the upper portion of the apparatus body 2, there is disposed an image scanning device 12 for scanning a document when the copy function or the facsimile function is used. On top of the apparatus body 2 and at the front of the image scanning device 12, there is provided an operation panel portion 14 which has various types of operation buttons or a liquid crystal display portion. The recording apparatus 11 and the sheet ejector portion 10 are disposed within a projected area in a plan view of the image scanning device 12 and the operation panel portion 14.

On the upper face of the image scanning device 12, there is disposed a placement glass plate (not shown) on which a document can be placed by opening a document cover 13 upwardly. Under the glass plate, an image scanner (contact image sensor [CIS]) (not shown) for scanning a document is disposed such that the image scanner is reciprocatable in a direction orthogonal to the drawing surface of FIG. 2 (main scanning direction or X-axis direction in FIG. 1).

As shown in FIG. 2 and FIG. 3, the recording apparatus 11 with the sheet feeder 7 has a frame 21 that is formed by bending a metal plate, which has been punch pressed into a predetermined shape, in the shape of a box with an upward opening. The frame 21 has a pair of right and left side plates 21*a* and 21*b* that extend in the sub-scanning direction (Y-axis direction) A first guide member 22 and a second guide member 23, which have a horizontally elongated plate shape and extend in the X-axis direction (main scanning direction), are disposed above across the pair of side plates 21*a* and 21*b*, leaving a space for accommodating the recording head 4 therebetween.

The carriage 5 is slidably supported (mounted) astride both guide members 22 and 23 to be capable of a reciprocating motion. Additionally, the plate-shaped platen 26 which supports a sheet P fed under the recording head 4 is provided within the frame 21. Incidentally, the first guide member 22 is disposed upstream of the direction of the sheet feed (the direction indicated by arrow A, see FIG. 3) in which a sheet P passes through on the platen 26, and the second guide member 23 is disposed downstream thereof.

Additionally, a feed roller shaft 27 is disposed upstream of the direction of the feed between the platen 26, and a follower roller 28 is in contact at a pressure with the outer circumference of the feed roller shaft 27. Rotating the feed roller shaft 27 causes a sheet P nipped between the feed roller shaft 27 and the follower roller 28 to be fed into the clearance between the lower nozzle face of the recording head 4 and the platen 26. A fly wheel (not shown) in contact with the upper face of a sheet P and a sheet ejector roller shaft 29 driven on the lower face side thereof are disposed downstream of the platen 26, and a recorded sheet P is fed to the sheet ejector portion 10.

Figure 4:
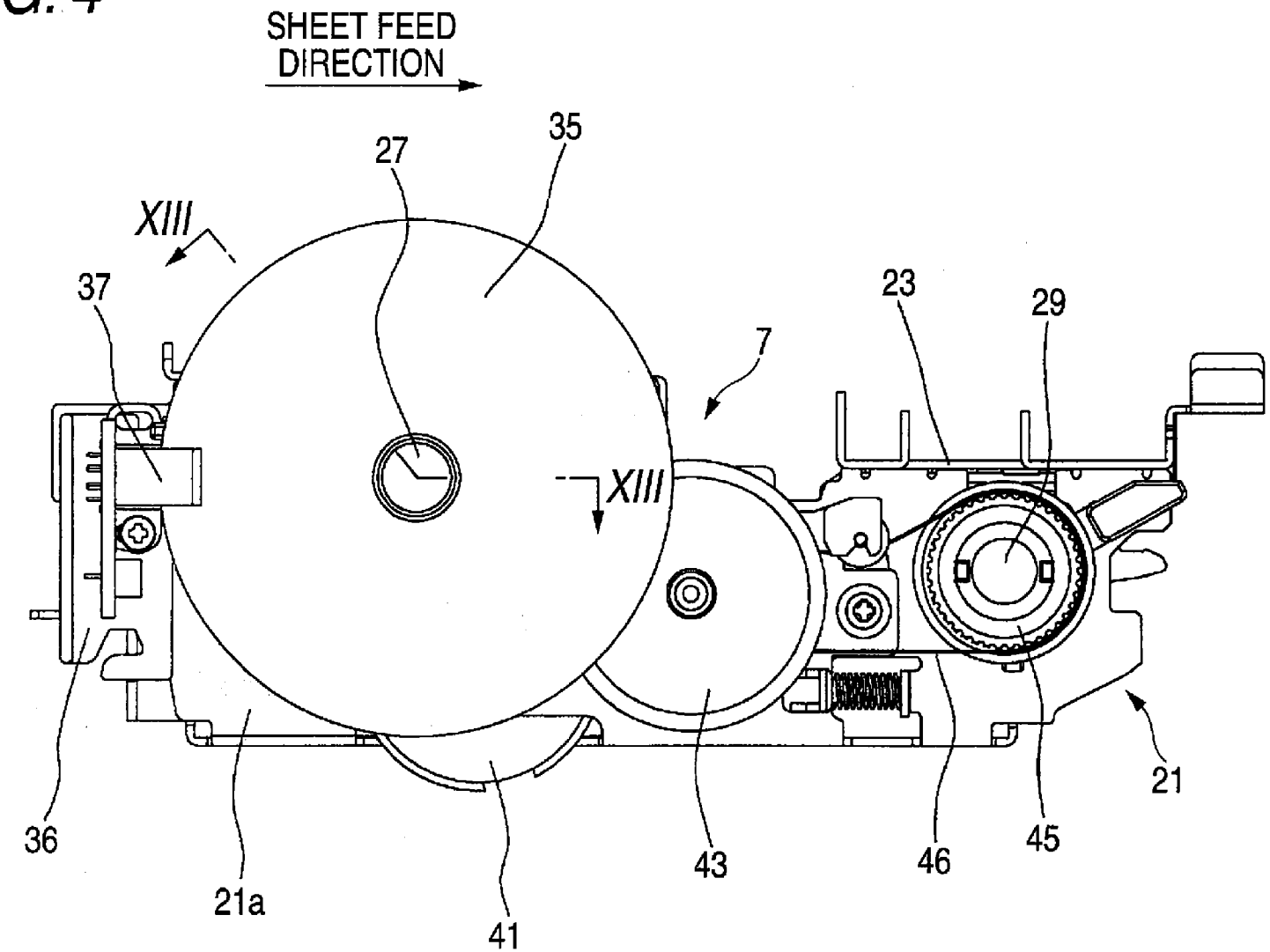
FIG. 4 is a side view illustrating a recording apparatus.
Figure 5:
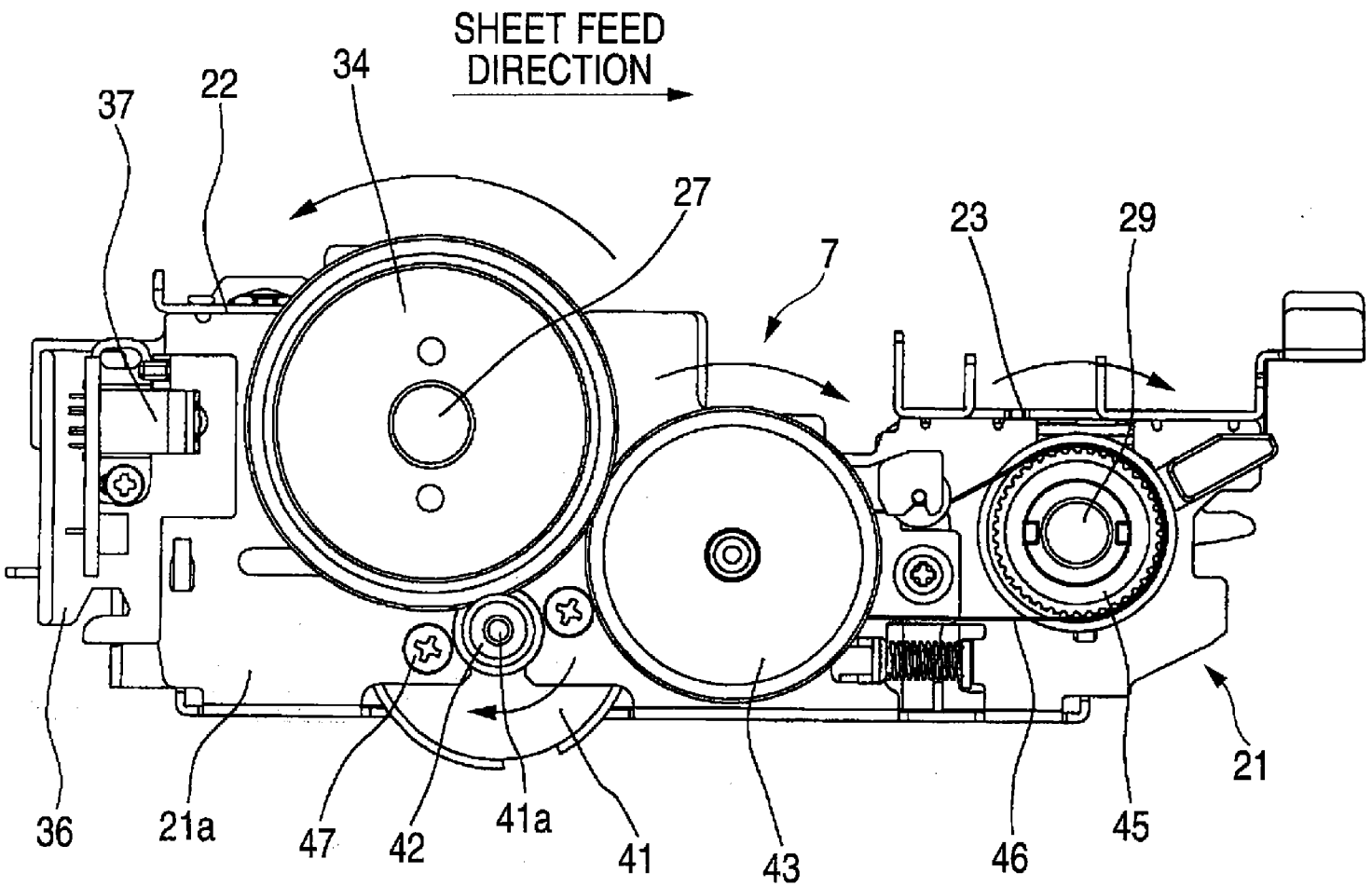
FIG. 5 is a side view illustrating a recording apparatus from which a disc is removed.
Figure 6:
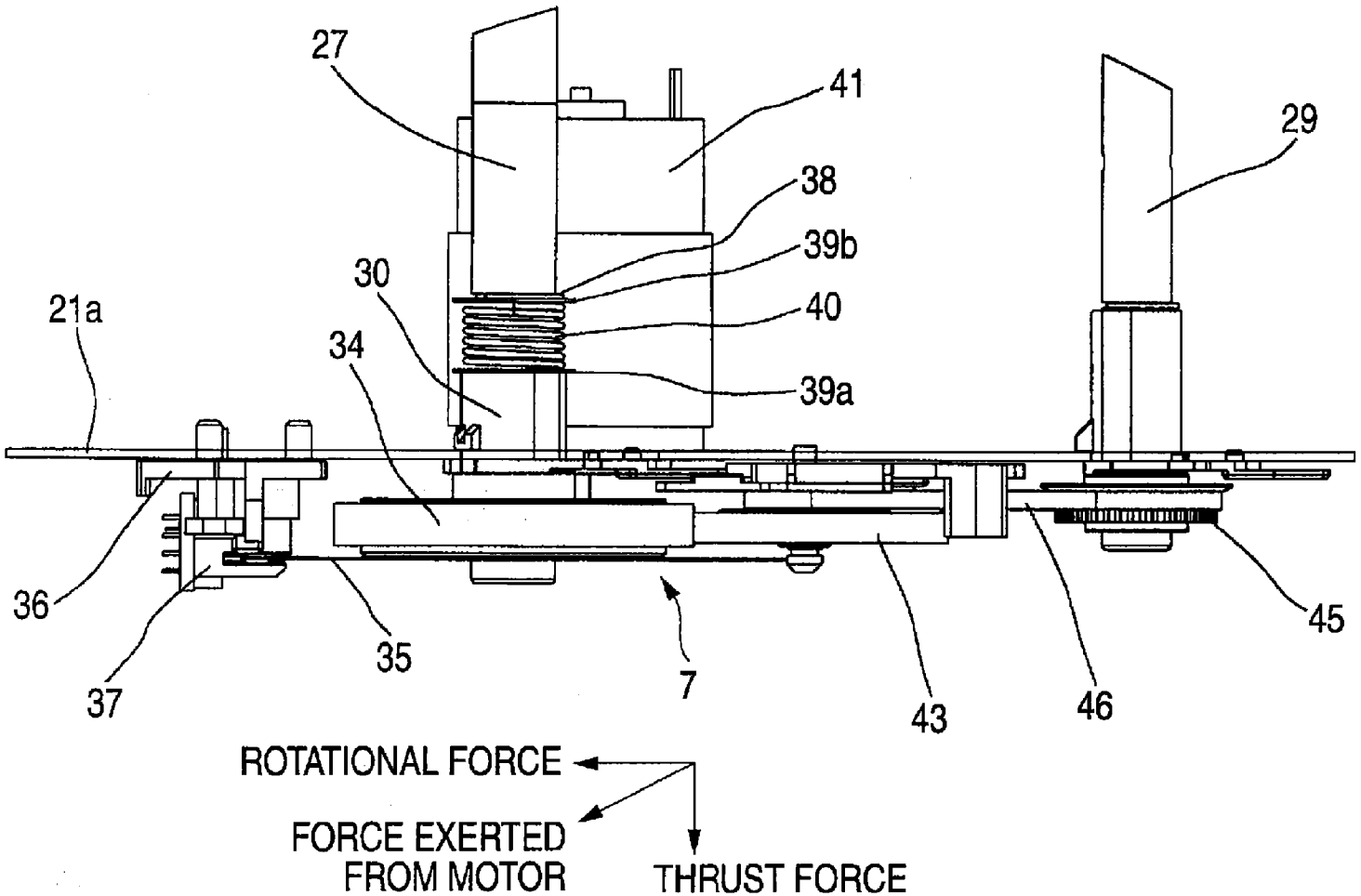
FIG. 6 is a plan view illustrating a recording apparatus.
Figure 7:
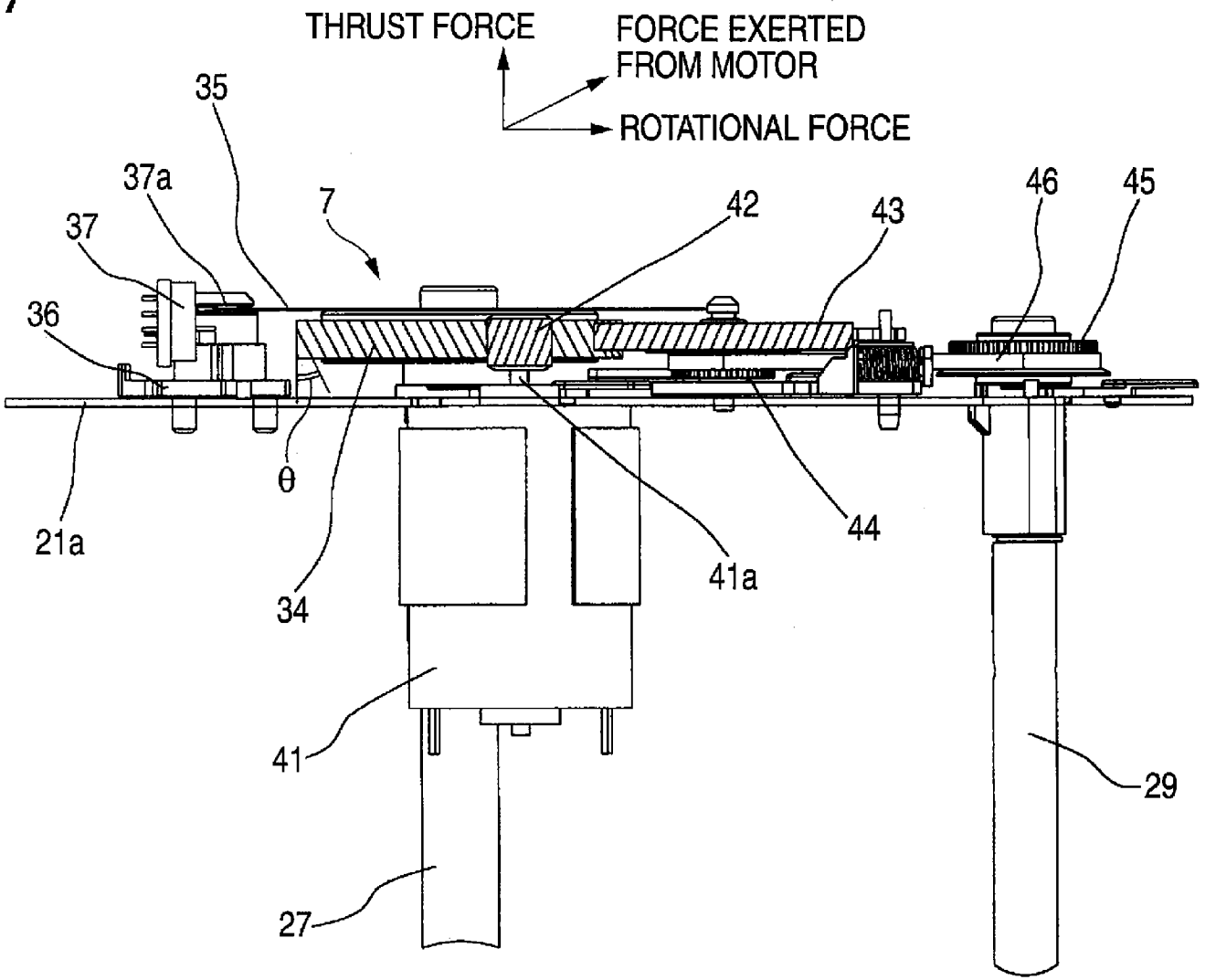
FIG. 7 is a bottom view illustrating a recording apparatus.
Figure 8:
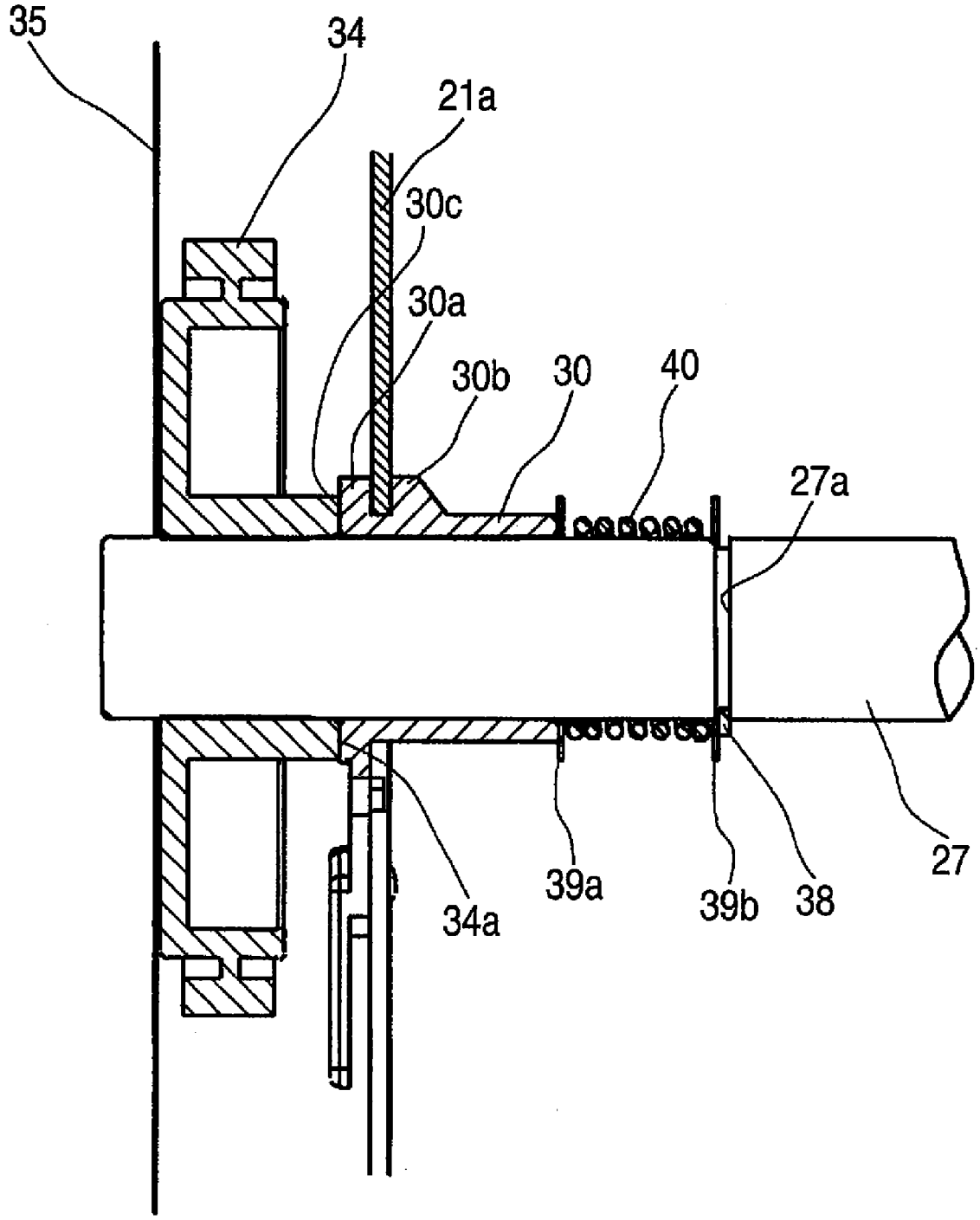
FIG. 8 is an enlarged sectional view taken along XIII-XIII of FIG. 4.

FIG. 4 is a side view illustrating the recording apparatus 11. FIG. 5 is a side view illustrating the recording apparatus 11 from which a disc is removed. FIG. 6 is a plan view illustrating the recording apparatus 11. FIG. 7 is a bottom view illustrating the recording apparatus 11. FIG. 8 is an enlarged sectional view taken along XIII-XIII of FIG. 4.

As shown in FIG. 3 and FIG. 6, the feed roller shaft 27 is rotatably supported via bearings 30 and 31 which are made of a synthetic resin and attached to the pair of right and left side plates 21*a* and 21*b*, respectively. As shown in FIG. 8, the bearing 30 for the left side plate 21*a* is a so-called sliding bearing.

The bearing 30 has a flange portion 30*a* formed to protrude radially. When the bearing 30 is attached to the left side plate 21*a*, the flange portion 30*a* contacts with the outer face of the left side plate 21*a*. Additionally, on the outer circumference of the bearing 30, a latch projection 30*b* is projected from the flange portion 30*a* with the thickness of the left side plate 21*a* provided therein. Thus, when the bearing 30 is attached to the left side plate 21*a*, the latch projection 30*b* contacts with the inner face of the left side plate 21*a* and prevents the bearing 30 from moving in the direction of thrust. Incidentally, the bearing 31 for the right side plate 21*a* is designed in the same manner and thus the bearing 31 is also prevented from moving in the direction of thrust.

One end of the feed roller shaft 27 protrudes from the bearing 30 outwardly with respect to the left side plate 21*a*, and a helical gear 34 is securely press fitted or screwed onto the feed roller shaft 27 outside the left side plate 21*a*. A disc 35 is attached to a side of the helical gear 34 coaxially with the feed roller shaft 27.

As shown in FIG. 4 to FIG. 7, the left side plate 21*a* of the frame 21 includes a sensor body 37 via a sensor holder 36. The sensor body 37 includes a slit 37*a*. The sensor body 37 is a well-known sensor which detects the rotation of the disc 35 optically or magnetically in a non-contact manner when the disc 35 passes through the slit 37*a* and then outputs a detection signal. The sensor body 37 is installed such that, when the disc 35 passes through the slit 37*a* of the sensor body 37, the end face of the helical gear 34 contacts with a reference end 30*c* of the bearing 30.

On the outer circumference of the feed roller shaft 27 inside the left side plate 21*a*, there is circumferentially formed a groove 27*a*, with a snap ring 38 fitted onto the groove 27*a*. The pair of washers 39*a* and 39*b*, and a coil spring 40 serving as a pressing member between both washers 39*a* and 39*b* are disposed on the feed roller shaft 27 between the snap ring 38 and the bearing 30 of the left side plate 21*a* coaxially with the feed roller shaft 27. The feed roller shaft 27 is disposed so as to penetrate through the pair of washers 39*a* and 39*b* and the coil spring 40.

The coil spring 40 is pre-compressed in order to press the feed roller shaft 27 in a thrust direction such that an end face 34*a* of the helical gear 34 contacts with the reference end 30*c* of the bearing 30. In other words, the coil spring 40 presses the feed roller shaft 27 in a direction toward another side of the feed roller shaft 27.

A drive motor 41 with a DC motor for feeding a sheet is attached to the inner face of the left side plate 21*a* of the frame 21 using a plurality of screws 47 in such a manner that a drive shaft 41*a* of the drive motor 41 is parallel to the feed roller shaft 27. The drive shaft 41*a* protrudes outwardly from the left side plate 21*a*, so that a drive helical gear 42 attached to the drive shaft 41*a* is meshed with the helical gear 34 of the feed roller shaft 27.

When the drive motor 41 is driven to rotate, the meshing of the helical gear 34 with the drive helical gear 42 causes a thrust force to act upon the feed roller shaft 27. The direction in which the thrust force is applied to the feed roller shaft 27 depends on the direction of tilt of the teeth of the helical gear 34 and the drive helical gear 42.

In this aspect, the drive motor 41 rotates in a normal direction in order to rotate the feed roller shaft 27 to feed a sheet P as indicated by an arrow shown in FIG. 5. In this case, a thrust force is designed to act upon the feed roller shaft 27 in a manner such that the end face 34*a* of the helical gear 34 moves apart from the reference end 30*c* of the bearing 30 during the rotation in the normal direction. At this time, a thrust force acts upon the drive shaft 41*a* as a reactive force in order to press the drive shaft 41*a* into the drive motor 41.

The coil spring 40 is formed such that when the drive motor 41 is rotated in the normal direction, the pressing force of the coil spring 40 is greater than the thrust force acting upon the feed roller shaft 27. The thrust force acting upon the feed roller shaft 27 is proportional to the force exerted by the drive motor 41 and depends on the tooth tilt θ of the helical gear 34 (see FIG. 7).

The drive torque provided by the drive motor 41 to feed a sheet P against various types of frictional forces may be measured to calculate the thrust force from the resulting drive torque in order to set the pressing force of the coil spring 40. The maximum torque of the drive motor 41 may be used to calculate the thrust force in order to set the pressing force of the coil spring 40. However, if the pressing force exceeds a predetermined value, frictional resistance may be increased and the drive torque of the drive motor 41 may be increased. Thus, the pressing force may be set in consideration of experimental results or the like.

The helical gear 34 is engaged with an idle helical gear 43 that is supported rotatably on the left side plate 21*a* of the frame 21. A toothed pulley 44 is integrally formed with the idle helical gear 43.

Like the feed roller shaft 27, the sheet ejector roller shaft 29 is rotatably supported by the pair of right and left side plates 21*a* and 21*b* in parallel with the feed roller shaft 27. The sheet ejector roller shaft 29 protruded from the left side plate 21*a* includes a toothed follower pulley 45. A toothed endless timing belt 46 is wound around the toothed pulley 44 and the follower pulley 45.

The rotation of the drive motor 41 is transmitted via the helical gear 34 to the sheet ejector roller shaft 29. Thus, frictional resistance or the like produced when the sheet ejector roller shaft 29 is rotated also affects the force that is exerted on the helical gear 34 by the drive motor 41. In this aspect, when the helical gear 34 is rotated, the thrust force determined by the drive torque for rotating the sheet ejector roller shaft 29 is added to the thrust force acting upon the feed roller shaft 27.

Now, description will be made for the operation of the recording apparatus 11 incorporating the sheet feeder 7 described above in conjunction with the operation of the image forming apparatus 1.

Sheets P are prepared in the sheet feed cassette 3, and the sheet feed cassette 3 is inserted and loaded through the opening portion 2*a*. Then, a topmost sheet P stacked in the sheet feed cassette 3 is separately fed in the direction of feed by means of the sheet feed roller 6. When the leading edge of the sheet P hits the nip portion of the feed roller shaft 27 and the follower roller 28, the sheet P is temporarily stopped and corrected for its inclined travel.

The drive motor 41 is rotated in the normal direction to rotate the feed roller shaft 27 in the direction of feed via the drive helical gear 42 and the helical gear 34. Accordingly, the sheet P is fed by a given amount and is fed to a predetermined position.

In conjunction with the rotation of the feed roller shaft 27, the disc 35 rotates, so that the rotation of the disc 35 is detected by the sensor body 37. In accordance with the rotation of the disc 35, the drive motor 41 is controlled to feed the sheet P to the predetermined position.

When executing printing, the feed roller shaft 27 is rotated to feed the sheet P. At this time, the sensor body 37 detects the rotation of the disc 35 and the drive motor 41 is controlled to allow the carriage 5 to reciprocate in conjunction with the sheet P being fed. Also, the recording head 4 is controlled to discharge ink and form an image on the sheet.

Additionally, when the drive motor 41 is rotated in the normal direction, the drive helical gear 42 is rotated in conjunction with the drive shaft 41*a*, while the helical gear 34 meshing with the drive helical gear 42 rotates in the reverse direction. At the same time, a thrust force acts upon the feed roller shaft 27. In this aspect, this thrust force acts to move the end face 34*a* of the helical gear 34 apart from the reference end 30*c* of the bearing 30. However, since the pressing force of the coil spring 40 is greater than the thrust force, the end face 34*a* of the helical gear 34 is kept in contact with the reference end 30*c* of the bearing 30.

Accordingly, the feed roller shaft 27 is prevented from being displaced in the direction of thrust, and the disc 35 is also prevented from moving in the direction of thrust. Accordingly, the disc 35 is prevented from moving within the slit 37*a* of the sensor body 37 in the direction of thrust to bring the disc 35 and the sensor body 37 into contact with each other, and is prevented from being worn out or scratched. Thus, the sensor body 37 can detect the rotation of the disc 35 without any problems.

Additionally, when the drive motor 41 is rotated in the reverse direction to return a sheet P by a predetermined amount, the reverse rotation of the drive motor 41 causes a thrust force to act upon the helical gear 34 in the direction opposite to the direction of the normal rotation. This thrust force acts to press the end face 34*a* of the helical gear 34 against the reference end 30*c* of the bearing 30.

Accordingly, even in the case of the reverse rotation, the end face 34*a* of the helical gear 34 is pressed against the reference end 30*c* of the bearing 30, so that the feed roller shaft 27 is prevented from moving in the direction of thrust and the disc 35 does not move in the direction of thrust. Accordingly, the disc 35 is prevented from moving within the slit 37*a* of the sensor body 37 in the direction of thrust to bring the disc 35 and the sensor body 37 into contact with each other, and the disc 35 is prevented from being worn out or scratched. Thus, the sensor body 37 can detect the rotation of the disc 35 without any problems.

In this aspect, when the drive motor 41 is rotated in the normal direction, the thrust force by the helical gear 34 acts to move the end face 34*a* of the helical gear 34 apart from the reference end 30*c* of the bearing 30. However, aspect of the present invention is not limited thereto. The helical gear 34 and the drive helical gear 42 may have opposite directions of tooth tilt, and the normal rotation of the drive motor 41 may cause the thrust force of the helical gear 34 to act in the direction to press the end face 34*a* of the helical gear 34 against the reference end 30*c* of the bearing 30. At this time, when the drive motor 41 is rotated in the reverse direction, the thrust force of the helical gear 34 acts to move the end face 34*a* of the helical gear 34 apart from the reference end 30*c* of the bearing 30. Since the pressing force of the coil spring 40 is greater than the thrust force, the end face 34*a* of the helical gear 34 is kept in contact with the reference end 30*c* of the bearing 30. Accordingly, the feed roller shaft 27 is prevented from moving in the direction of thrust, and the disc 35 is prevented from moving in the direction of thrust as well.

Incidentally, some drive motors 41 are designed such that their own internal structure causes the drive shaft 41*a* to be pressed into the drive motor 41. Accordingly, when the drive motors 41 are stopped being driven after the feed roller shaft 27 has been rotated by a predetermined amount, their own pressing force acts to pull the drive shaft 41*a* into the drive motor 41.

In this aspect, when the drive motor 41 is rotated in the normal direction, the teeth of the drive helical gear 42 are subjected to the reactive force from the teeth of the helical gear 34. This reactive force causes the drive shaft 41*a* to be subjected to a thrust force opposite in direction to the thrust force acting on the feed roller shaft 27. The thrust force caused by the reactive force acts in the direction to press the drive shaft 41*a* into the drive motor 41.

Additionally, when the drive motor 41 is rotated in the normal direction and the reactive force on the drive helical gear 42 presses the drive shaft 41*a* into the drive motor 41, the drive shaft 41*a* is prevented from moving in the direction of thrust when the drive motor 41 is stopped being driven.

In contrast, when the drive motor 41 is rotated in the reverse direction, the reactive force on the drive helical gear 42 causes the thrust force to act so as to pull the drive shaft 41*a* out of the drive motor 41. This allows the drive shaft 41*a* to be drawn out of the drive motor 41 against the pressing provided by its own internal structure of the drive motor 41. Then, when the drive motor 41 is stopped being driven, the pressing provided by its own internal structure of the drive motor 41 allows the drive shaft 41*a* to be pulled back into the drive motor 41.

Since both helical gear 34 and the drive helical gear 42 are used, the feed roller shaft 27 may be rotated via the helical gear 34 when the drive shaft 41*a* is moved in the direction of thrust even after the rotation of the drive motor 41 has been stopped. In such a case, the sheet P may be fed and stopped at an inaccurate position. However, such reverse rotation of the drive motor 41 happens only when a sheet P is returned during a non-printing operation. Thus, there is no problem even if the sheet P is inaccurately stopped at a position.

According to another aspect of the invention, the disc passes through a slit in the sensor body.

According to still another aspect of the invention, the pressing member is a coil spring disposed coaxially with the feed roller shaft.

According to still another aspect of the invention, the feed roller shaft penetrates through the coil spring.

According to still another aspect of the invention, the motor includes: a drive shaft; and a drive helical gear that is attached to the drive shaft and meshes with the helical gear, and wherein when the motor rotates in a normal direction to feed the sheet, a thrust force produced by the drive helical gear acts upon the feed roller shaft to separate the helical gear from the feed roller shaft. For example, when the motor is rotated in the normal direction, the pressing of the pressing member causes the feed roller shaft to be pressed to another side of the feed roller shaft against the thrust force of the helical gear. On the other hand, when the motor is rotated in the reverse direction, the pressing member causes the feed roller shaft to be pressed to another side of the feed roller shaft in conjunction with the thrust force of the helical gear.

According to still another aspect of the invention, the drive shaft is pressed in a thrust direction so as to be pulled into the motor, and a direction of a reaction force, reactive to the thrust force, acted upon the feed roller shaft is in a same direction as the drive shaft is pressed in. Accordingly, with the drive shaft of the motor being pressed in the direction of thrust, this pressing does not cause the drive shaft to move in the direction of thrust after the motor has been stopped.

According to still another aspect of the invention, the pressing member presses the feed roller shaft with a force greater than a thrust force applied to the feed roller shaft.

According to still another aspect of the invention, the sheet feeder further includes: a bearing shaft that is mounted to the frame and rotatably supports the feed roller shaft.

According to still another aspect of the invention, the pressing member presses the feed roller shaft such that a part of the helical gear contacts with one end of the bearing shaft.

According to still another aspect of the invention, the pressing member contacts with another end of the bearing shaft.

According to still another aspect of the invention, the feed roller shaft further includes a first fixing member provided on an outer circumference thereof, the bearing shaft further includes a second fixing member provided on an end thereof, and the pressing member is interposed between the first fixing member and the second fixing member.

According to still another aspect of the invention, the sensor body is attached to the frame.

According to above aspects of the invention, even when the disc is adapted to pass through the slit, the disc is restricted from moving in the direction of thrust. Thereby, the disc is prevented from being worn out or scratched. Furthermore, a coil spring serving as the pressing member is disposed coaxially with the feed roller shaft, so that the feed roller shaft penetrates through the coil spring. Accordingly, the apparatus is prevented from increasing in size even when a pressing member is provided.

Further, according to above aspects of the invention, when the motor rotates in the normal direction, the pressing of the pressing member causes the feed roller shaft to be pressed to the reference end against the thrust force of the helical gear. On the other hand, when the motor rotates in the reverse direction, the pressing causes the feed roller shaft to be pressed to the reference end in conjunction with the thrust force of the helical gear. Accordingly, the disc is prevented from moving in the direction of thrust. Additionally, with the drive shaft of the motor being pressed in the direction of thrust, the drive shaft is prevented from moving in the direction of thrust and the feed roller shaft from rotating after the motor has been stopped.

Although the present invention is described in accordance with exemplary aspects, the present invention is not limited thereto. Various modifications may be made thereto.

What is claimed is:

1. A sheet feeder comprising:

a feed roller that includes a feed roller shaft, the feed roller being capable of feeding a sheet;

a frame that supports the feed roller shaft;

a helical gear attached to the feed roller shaft;

a motor that drives the feed roller shaft via the helical gear;

a disc attached to the feed roller shaft;

a sensor body that detects a rotation of the disc;

a pressing member that presses the feed roller shaft, to which both the disc and the helical gear are attached, in a thrust direction of the feed roller shaft; and a bearing shaft that is mounted to the frame and rotatably supports the feed roller shaft, wherein the pressing member presses the feed roller shaft such that a part of the helical gear contacts with one end of the bearing shaft.

2. The sheet feeder according to claim 1, wherein the pressing member is a coil spring disposed coaxially with the feed roller shaft.

3. The sheet feeder according to claim 2, wherein the disc passes through a slit in the sensor body.

4. The sheet feeder according to claim 2, wherein the feed roller shaft penetrates through the coil spring.

5. The sheet feeder according to claim 2, wherein the motor comprises: a drive shaft; and a drive helical gear that is attached to the drive shaft and meshes with the helical gear, and wherein when the motor rotates in a normal direction to feed the sheet, a thrust force produced by the drive helical gear acts upon the feed roller shaft to separate the helical gear from the feed roller shaft.

6. The sheet feeder according to claim 2, wherein the pressing member presses the feed roller shaft with a force greater than a thrust force applied to the feed roller shaft.

7. The sheet feeder according to claim 2, wherein the sensor body is attached to the frame.

8. The sheet feeder according to claim 2, wherein the frame is disposed between the helical gear and the pressing member.

9. The sheet feeder according to claim 1, wherein the pressing member contacts with another end of the bearing shaft.

10. The sheet feeder according to claim 1, wherein the feed roller shaft further comprises a first fixing member provided on an outer circumference thereof, wherein the bearing shaft further comprises a second fixing member provided on an end thereof, and wherein the pressing member is interposed between the first fixing member and the second fixing member.

11. The sheet feeder according to claim 1, wherein the frame is disposed between the disc and the pressing member.

12. A sheet feeder comprising:

a feed roller that includes a feed roller shaft, the feed roller being capable of feeding a sheet;

a frame that supports the feed roller shaft;

a helical gear attached to the feed roller shaft;

a motor that drives the feed roller shaft via the helical gear;

a disc attached to the feed roller shaft;

a sensor body that detects a rotation of the disc; and a pressing member that presses the feed roller shaft, to which both the disc and the helical gear are attached, in a thrust direction of the feed roller shaft;

wherein the pressing member is a coil spring disposed coaxially with the feed roller shaft, wherein the motor comprises: a drive shaft; and a drive helical gear that is attached to the drive shaft and meshes with the helical gear, wherein when the motor rotates in a normal direction to feed the sheet, a thrust force produced by the drive helical gear acts upon the feed roller shaft to separate the helical gear from the feed roller shaft, and wherein the drive shaft is pressed in a direction so as to be pulled into the motor, and wherein a direction of a reaction force, reactive to the thrust force, acted upon the feed roller shaft is in a same direction as the drive shaft is pressed in.

13. An image forming apparatus comprising:

a sheet feed unit that feeds stacked sheets one at a time;

an image forming unit that forms an image on a sheet fed from the sheet feed unit, the image forming unit comprising a sheet feeder comprising:

a feed roller that includes a feed roller shaft, the feed roller being capable of feeding a sheet;

a frame that supports the feed roller shaft;

a helical gear attached to the feed roller shaft;

a motor that drives the feed roller shaft via the helical gear;

a disc attached to the feed roller shaft;

a sensor body that detects a rotation of the disc;

a pressing member that presses the feed roller shaft, to which both the disc and the helical gear are attached, in a thrust direction of the feed roller shaft; and a bearing shaft that is mounted to the frame and rotatably supports the feed roller shaft; and a sheet ejector that ejects the sheet on which the image is formed;

wherein the pressing member is a coil spring disposed coaxially with the feed roller shaft, and wherein the pressing member presses the feed roller shaft such that a part of the helical gear contacts with one end of the bearing shaft.

* * * * *